US009151035B2

(12) United States Patent
Mason

(10) Patent No.: US 9,151,035 B2
(45) Date of Patent: Oct. 6, 2015

(54) DOUBLE AXIS FRAME STRUT

(71) Applicant: Paul Mason, Minden, NV (US)

(72) Inventor: Paul Mason, Minden, NV (US)

( * ) Notice: Subject to any disclaimer, the term of this patent is extended or adjusted under 35 U.S.C. 154(b) by 0 days.

(21) Appl. No.: 13/826,903

(22) Filed: Mar. 14, 2013

(65) Prior Publication Data

US 2013/0255184 A1 Oct. 3, 2013

Related U.S. Application Data

(60) Provisional application No. 61/616,213, filed on Mar. 27, 2012.

(51) Int. Cl.

| | |
|---|---|
| ***E04B 1/18*** | (2006.01) |
| ***E04B 1/26*** | (2006.01) |
| ***E04B 1/32*** | (2006.01) |
| ***E04B 1/19*** | (2006.01) |
| *E04B 1/24* | (2006.01) |
| *E04H 15/58* | (2006.01) |

(52) U.S. Cl.

CPC . *E04B 1/18* (2013.01); *E04B 1/185* (2013.01); *E04B 1/32* (2013.01); *E04B 1/2403* (2013.01); *E04B 1/2604* (2013.01); *E04B 1/3211* (2013.01); *E04B 2001/2616* (2013.01); *E04B 2001/3241* (2013.01); *E04H 15/58* (2013.01)

(58) Field of Classification Search

CPC ..... E04B 1/18; E04B 1/32; E04B 1/19; E04B 1/1903; E04B 1/0909; E04B 1/2403; E04B 7/10; E04B 7/105; E04B 2001/3247; E04B 2001/3241; E04B 2001/3235; E04B 2001/1921; E04B 2001/1924; E04B 2001/1957; E04B 2001/1981; E04B 2001/1975; E04B 2001/1978; E04B 2001/2406; E04B 1/3211; E04B 1/185; E04B 1/2604; E04B 2001/2616; E04H 15/58

USPC ..... 52/831, 80, 81.2, 81.3, 646, 655.1, 52/655.2; 403/217, 218, 169, 170, 171, 403/172, 173, 174, 175, 176, 178

See application file for complete search history.

(56) References Cited

U.S. PATENT DOCUMENTS

| | | | | |
|---|---|---|---|---|
| 3,521,421 | A * | 7/1970 | Schroeder, Jr. | 52/648.1 |
| 4,368,749 | A * | 1/1983 | Lindler et al. | 135/15.1 |
| 5,797,695 | A * | 8/1998 | Prusmack | 403/170 |
| 6,205,739 | B1 * | 3/2001 | Newlin | 52/655.1 |
| 8,418,710 | B2 * | 4/2013 | Zhou | 135/135 |

* cited by examiner

*Primary Examiner* — Jessica Laux
(74) *Attorney, Agent, or Firm* — Dergosits & Noah LLP

(57) ABSTRACT

A double axis frame strut has a strut frame and a tongue that extends from a distal end of the strut frame. The tongue can be rigidly coupled to an axle that is rotatably coupled to the strut frame and extends from a distal end of the strut frame. The tongue can rotate relative to the strut frame and the tongue can include a hole which can be coupled to other double axis frame struts or other structure. The hole in the tongue can define a first axis of rotation and the axle can define a second axis of rotation. The axis of the hole in the tongue can be perpendicular to the axis of rotation of the tongue relative to the strut frame.

8 Claims, 17 Drawing Sheets

131

DOUBLE AXIS FRAME STRUT

CROSS REFERENCE TO RELATED APPLICATIONS

This application claims priority to U.S. Provisional Application No. 61/616,213, "Geodesic Double Axis Strut Connection Design" filed Mar. 27, 2012 which is hereby incorporated by reference in its entirety.

BACKGROUND

There are many connectors currently available for connecting the ends of various elongated framing components including: beams, posts, etc. While these connectors are commonly used for normal construction which involves primarily right or 90 degree angles, there are very few connectors that provide the required strength for other multiple angle junctions. Multiple angle connectors can be particularly important for complex framing geometries for structures such as geodesic domes.

SUMMARY OF THE INVENTION

The present invention is directed towards a double axis frame strut having a strut frame and a tongue that extends from a distal end of the strut frame. The tongue can be rigidly coupled to an axle that can be rotatably coupled to the strut frame. The tongue extends from a distal end of the strut frame. The tongue can rotate relative to the strut frame and the tongue can include a hole which can be coupled to other double axis frame struts or other structure. The hole in the tongue can define a first axis of rotation and the axle can define a second axis of rotation. The axis of the hole in the tongue can be perpendicular to the axis of rotation of the tongue relative to the strut frame.

In different embodiments, there can be various different tongue and strut frame designs. These different tongues and strut frames can be mixed and matched to best suit the needs of the structure being assembled. In some embodiments, the tongue can rotate freely within a limited range of angles. This can be useful when a high strength structure is required but the coupling points between the adjacent elongated members needs to be flexible. For example, if the structure expands and contracts due to factors such as thermal expansion, this loose configuration may be suitable. In other embodiments, the tongue can be rotated within the strut frame but can also be locked or rigidly secured into a set position. In these embodiments, the axle may include a threaded bolt and nut that can be tightened to clamp the strut frame to the tongue and prevent relative movement.

The holes in the tongues of the double axis frame struts can be coupled together with a fastener such as a nut and bolt. The double axis frame struts can be arranged in a radial configuration around the bolt. When the desired positions of the double axis frame strut are set, the nut and bolt can be tightened to secure the double axis frame struts. These hub connections can normally include between 2 and 6 double axis frame struts. The inventive double axis frame struts can be used for framing various types of structures including geodesic domes and more traditional free standing or supported structures.

DETAILED DESCRIPTION

The present invention is directed towards a double axis frame strut. In an embodiment, the double axis frame strut can consist of a tongue and a strut frame. The tongue extends from a distal end of the strut frame. The tongue can rotate relative to the strut frame and the tongue can include a hole which can be coupled to other double axis frame struts or other structure. The center axis of the hole in the tongue can define one axis of rotation and the rotation of the tongue relative to the strut frame can define the second axis of rotation. The axis of the hole in the tongue can be perpendicular to the axis of rotation of the tongue relative to the strut frame.

A proximal end of the double axis frame strut can be attached to an elongated member such as tubing, pipe, beams, etc. and the elongated member can be made of various materials including: plastic, metal, wood, composites, etc. The tongue at the distal end of the frame strut can be bolted and connected to an axis point adjoining to other double axis frame struts at locked various angles to form any desired framing necessary. The framing that is fabricated with the double axis frame struts can be used for various structures including: gazebos, small buildings, green houses, pavilions, umbrellas, rescue equipment, etc. The framing can be constructed on level surfaces or on uneven ground. In other embodiments, the double axis frame struts can be used in scaffolding, safety manhole boxes, trench shoring, universal tripods, shelving, carports, walkway covers, trussing and any other framing systems.

The inventive double axis frame strut can have various configurations. Two components of the double axis frame strut are the tongue and the strut frame. The tongue and strut frame can each have various different designs and constructions. It is also possible to mix and match the different tongue and strut frame designs. Thus, the tongues and strut frames will be described separately but one of ordinary skill in the art will know that these different tongue and strut frame designs can be mixed and matched.

Figure 1:
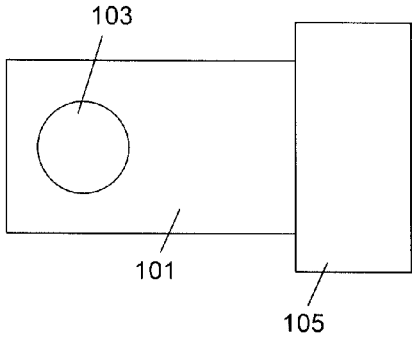
FIGS. 1 and 2 illustrate top and side views of a first embodiment of a tongue.
Figure 2:
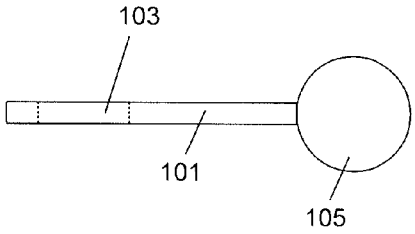

With reference to FIGS. 1-8 different embodiments of the tongue are illustrated. FIG. 1 illustrates a top view of a first embodiment of a tongue and FIG. 2 illustrates a side view of the first embodiment of the tongue. A distal portion of the double axis tongue 101 can include a mounting hole 103 and a proximal end of the tongue can be coupled to a cylinder 105. The axis of the cylinder 105 can be perpendicular to the length of the tongue 101 and parallel to the plane of the tongue 101. The tongue 101 can be made from sheet metal and the cylinder 105 can be made from a metal cylindrical rod. The tongue 101 can be coupled to the cylinder 105 by welding the tongue 101 to the cylinder 105. The length of the cylinder 105 can be longer than the width of the tongue 101 and ends of the cylinder 105 can extend beyond the width of the tongue 101.

Figure 3:
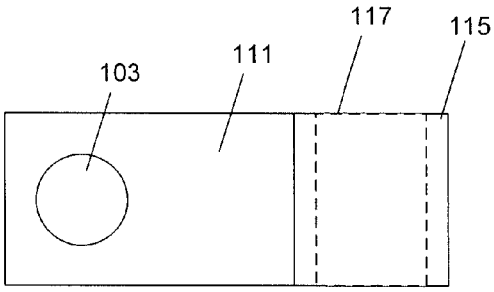
FIGS. 3 and 4 illustrate top and side views of a second embodiment of a tongue.
Figure 4:
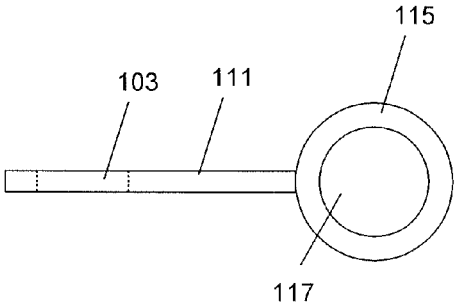

FIG. 3 illustrates a top view and FIG. 4 illustrates a side view of a second embodiment of a tongue 111. In this embodiment, the tongue 111 is coupled to a tube 115 having a through bore 117. The axis of the bore 117 can be perpendicular to the length of the tongue 111 and parallel to the plane of the tongue 111. The cylinder 115 can be made of metal tubing and the tongue 101 can be welded to the cylinder 105. The length of the tube 115 can be equal or longer than the width of the tongue 101.

Figure 5:
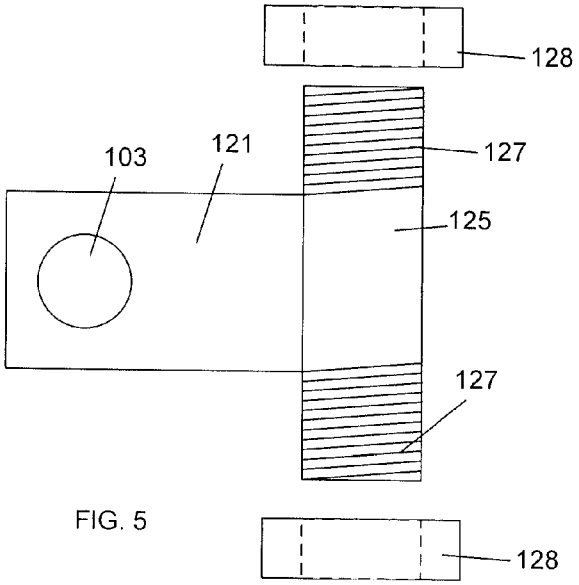
FIGS. 5 and 6 illustrate top and side views of a third embodiment of a tongue.
Figure 6:
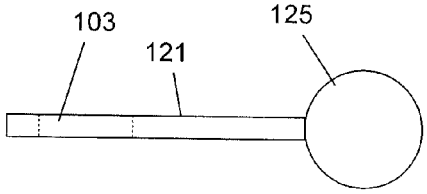

FIG. 5 illustrates a top view and FIG. 6 illustrates a side view of a third embodiment of a tongue 121. The axis of the cylinder 125 can be perpendicular to the length of the tongue 121 and parallel to the plane of the tongue 121. The tongue 121 and the cylinder 125 can be made of metal and the tongue 121 can be welded to the cylinder 125. The length of the cylinder 125 can be longer than the width of the tongue 121 and ends of the cylinder 125 can extend beyond the width of the tongue 121 and the ends or the entire cylinder 125 can be threaded 127. When installed in the strut frame, the threaded ends 127 of the cylinder 125 can be secured to nuts having corresponding threads to secure the tongue 121 to the strut frame.

Figure 7:
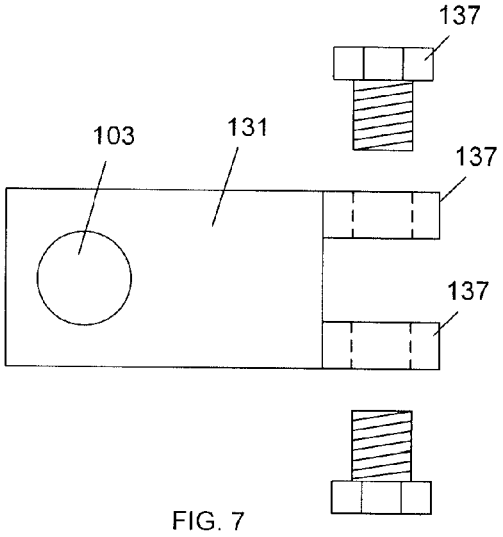
FIGS. 7 and 8 illustrate top and side views of a forth embodiment of a tongue.
Figure 8:
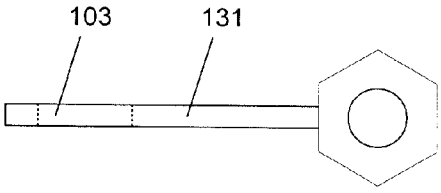

FIG. 7 illustrates a top view and FIG. 8 illustrates a side view of a forth embodiment of a tongue 131. In this embodiment, the end of the tongue can be welded or coupled in any other manner to two threaded nuts 135. In other embodiments, the nuts 135 can be replaced with any other suitable structures that have internal threads. The axis of the cylinder 125 can be perpendicular to the length of the tongue 131 and parallel to the plane of the tongue 131. In this embodiment, the nuts 135 can be coupled to bolts 137 having corresponding threads. Although illustrated as two separate nuts 135 in other embodiments, the tongue 131 can be coupled to a single threaded nut or tubular structure that extends across the entire width of the tongue 131.

Figure 8A:
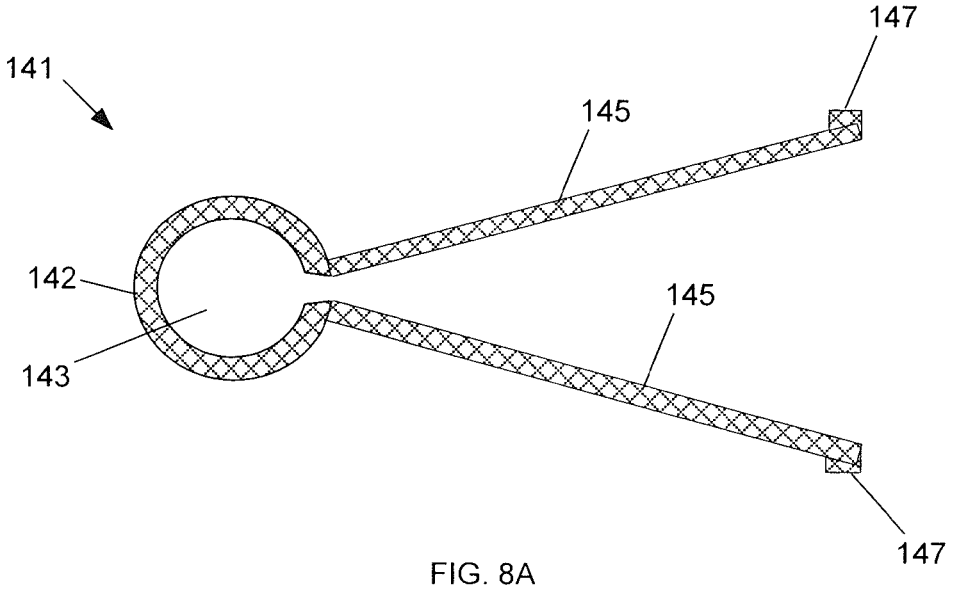
FIGS. 8A illustrates a top view of a fifth embodiment of a tongue.

FIG. 8A illustrates a top view of a fifth embodiment of a tongue 141. In this embodiment, the tongue 141 is a single integral piece of wire rod formed as shown. In one embodiment, the wire rod is made from steel and measures 0.187 inches outside diameter, with a total length of approximately 3 inches. One end of the tongue 141 is a circular portion 142 defining an opening 143. A pair of legs 145 extends from the circular portion 142 and the legs diverge at an acute angle. At the end of each leg 145 is a tab 147.

Figure 9:
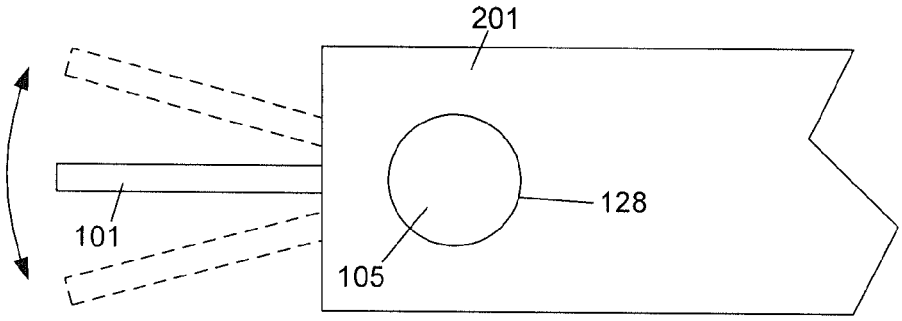
FIGS. 9-11 illustrate side, front and top views of a first embodiment of the double axis frame strut.
Figure 10:
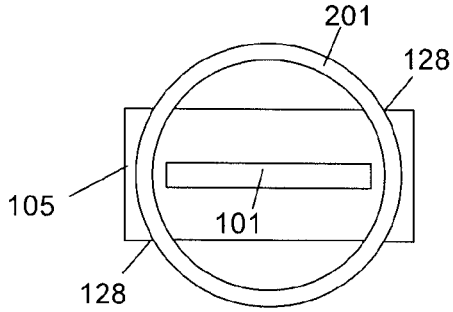
Figure 11:
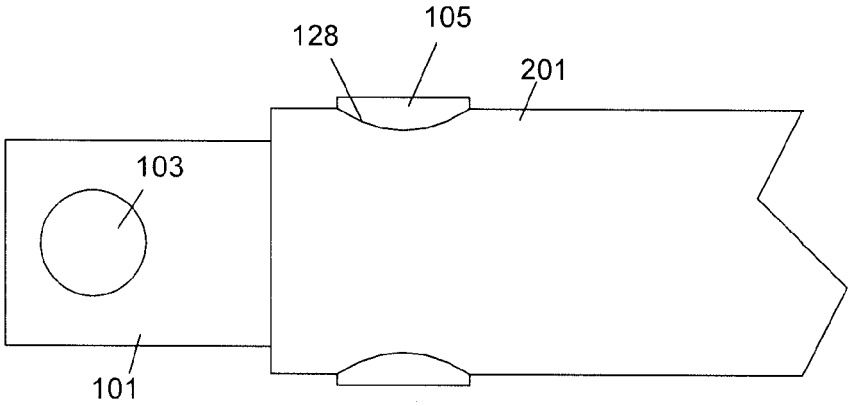

The tongues illustrated in FIGS. 1-8A can be coupled to various types of strut frames. With reference to FIGS. 9-11A, an embodiment of the strut frame 201 is illustrated with the tongue 101 shown in FIGS. 1-2. FIG. 9 illustrates a side view, FIG. 10 illustrates a front view and FIG. 11 illustrates a top view of a first embodiment of a strut frame 201 with the tongue 101 illustrated in FIGS. 1 and 2. In this embodiment, the strut frame 201 is a cylindrical tube having two mounting holes 103 on opposite sides. The ends of the cylinder 105 extend outward beyond the strut frame 201 and the tongue 101 is within the inner diameter of the strut frame 201. The tongue 101 also prevents the cylinder 105 from falling out of the mounting holes 103. The cylinder 105 can rotate within the mounting holes 103 allowing the tongue 101 to rotate as shown in FIG. 9.

Figure 11A:
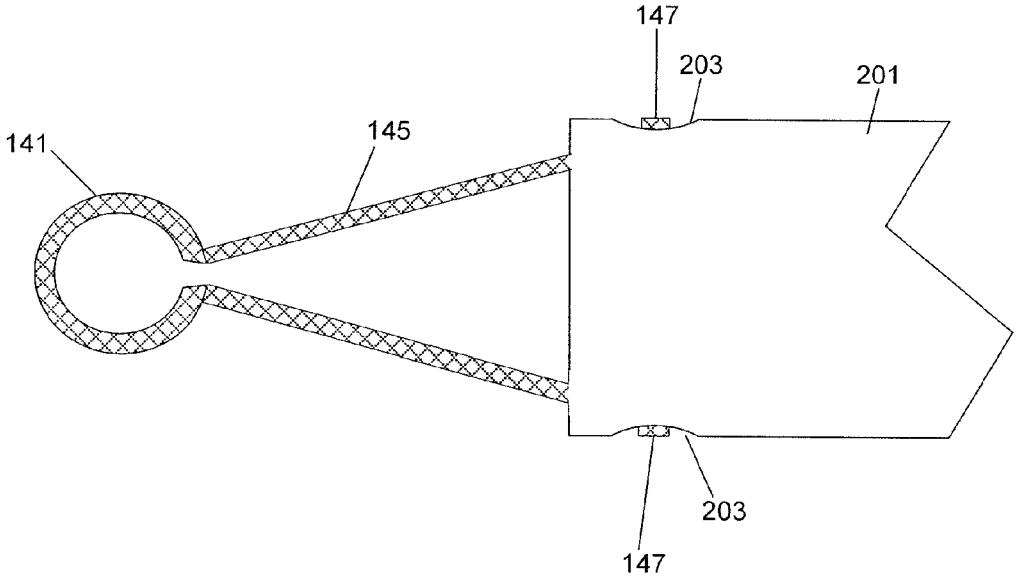
FIG. 11A illustrates a top view of an embodiment of the tongue of FIG. 8A engaged with the double axis frame strut of FIG. 11.

FIG. 11A illustrates the fifth embodiment of tongue 141 engaged with strut frame 201. The legs 145 of the tongue 141 may be squeezed together to push the tongue inside of strut frame 201 until the tabs 147 pop into openings 203 on the strut frame.

This embodiment of the strut frame 201 can be fabricated on one or both ends of a tubular beam. Alternatively, the strut frame 201 can be coupled to any beam. For example, the inner diameter of the strut frame 201 can be bonded and/or fastened to the outer diameter of a cylindrical beam or the outer diameter of the strut frame 201 can be bonded and/or fastened to the inner diameter of a cylindrical tubular beam. In order to place the tongue 101 in the strut frame 201, the cylinder 105 can placed in the mounting holes 128 before the tongue 101 is welded to the cylinder 105.

Figure 12:
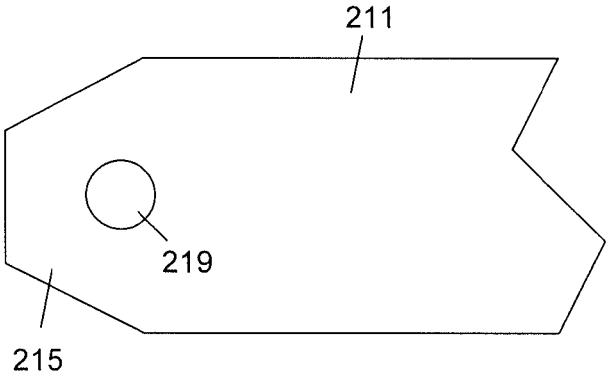
FIG. 12 illustrates a side view of an embodiment of a strut frame.
Figure 13:
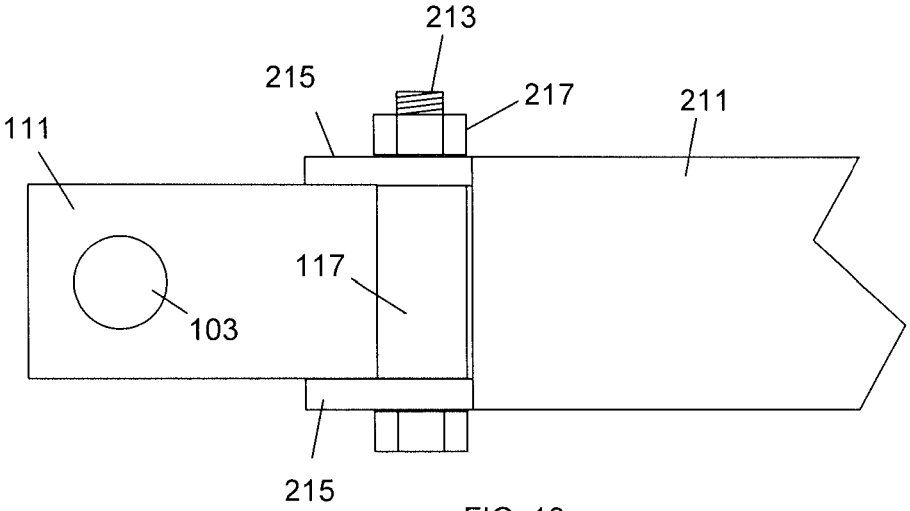
FIGS. 13-15 illustrate top, front and side views of a second embodiment of the double axis frame strut.
Figure 14:
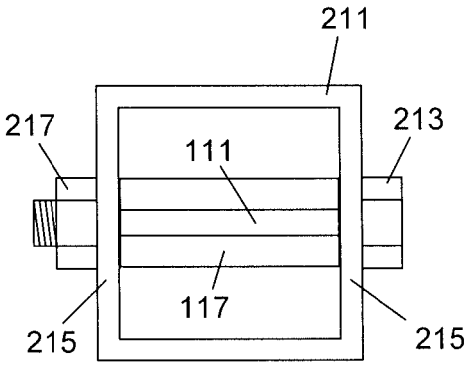
Figure 15:
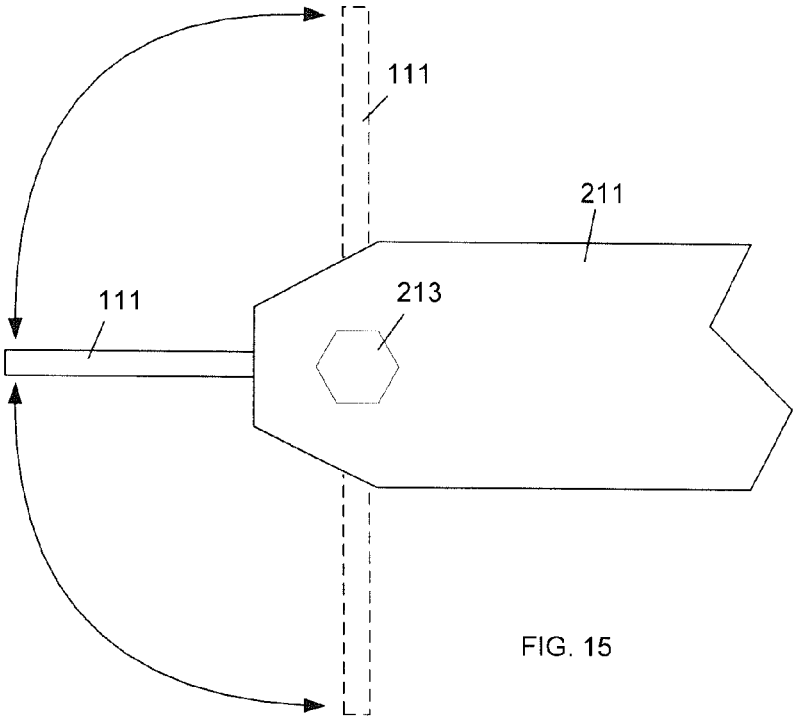

A second embodiment of a strut frame 211 is illustrated in FIGS. 12-14. The strut frame 211 can have a rectangular cross section. FIG. 12 illustrates a side view of the strut frame 211 without a tongue. The strut frame 211 can include two substantially parallel arms 215 and a mounting hole 219 formed in each of the arms 215. FIG. 13 illustrates a top view and FIG. 14 illustrates a front view of the strut frame 211 with the tongue 111 illustrated in FIGS. 3 and 4. In this embodiment, the tongue 111 is placed between the arms 215 with the tube 115 aligned with the mounting holes 105. A threaded bolt 213 extends through mounting holes 105 and a nut 217 is secured to the end of the bolt 213. The tongue 111 can normally rotate about the bolt 213 as shown in FIG. 14. However, if the nut 217 is tightened, the arms 215 can be compressed against the ends of the tube 115 which can prevent the tongue 111 from rotating. FIG. 15 illustrates a side view of the strut frame 211 with the tongue 111. The tongue 111 can have a range motion that can be greater than 180 degrees.

Figure 16:
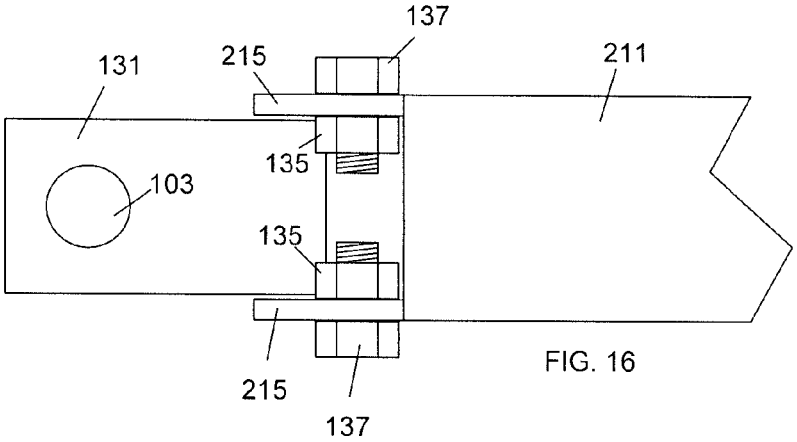
FIGS. 16 and 17 illustrate top and front views of a third embodiment of the double axis frame strut.
Figure 17:
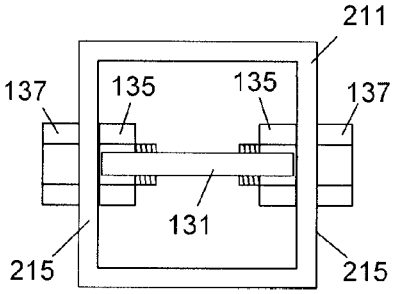

FIG. 16 shows a top view and FIG. 17 shows a front view of a third embodiment of a double axis frame strut that includes the second embodiment of the strut frame 211 combined with the tongue 131 shown in FIGS. 7 and 8. A side view of the strut frame 211 is shown in FIG. 11. In this embodiment, the tongue 131 is coupled to two threaded nuts 135. Bolts 137 are placed through the holes 219 in the strut frame 211 and secured the threaded nuts 135. The tongue 131 can rotated relative to the strut frame 211 as shown in FIG. 14. However, by tightening the bolts 137, the tongue 131 can be rigidly secured to the strut frame 211.

Figure 18:
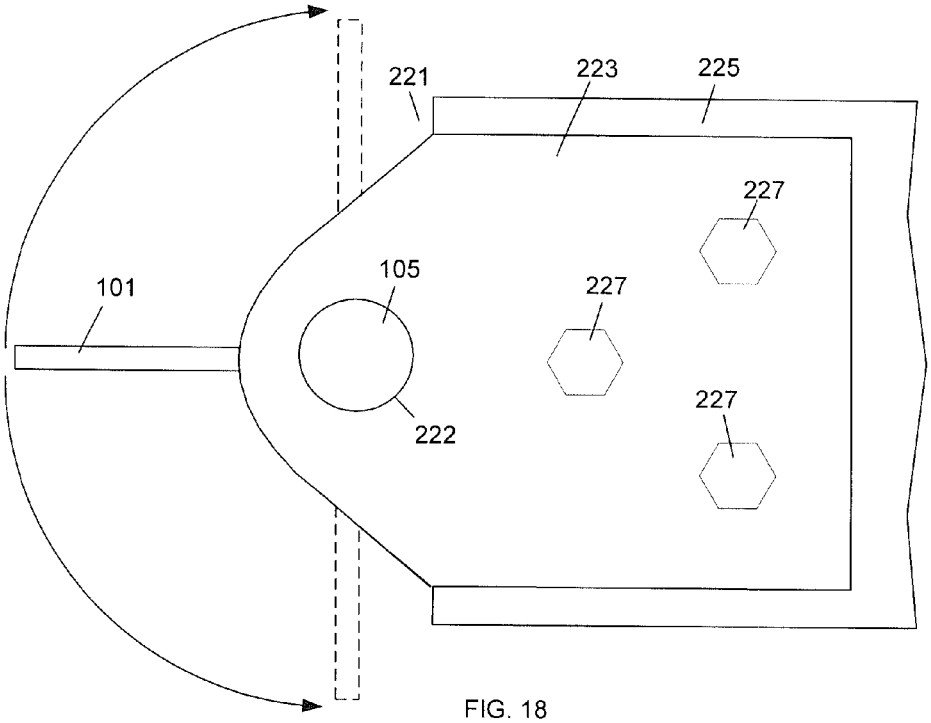
FIGS. 18-20 illustrate side, top and front views of additional embodiments of the double axis frame strut.
Figure 19:
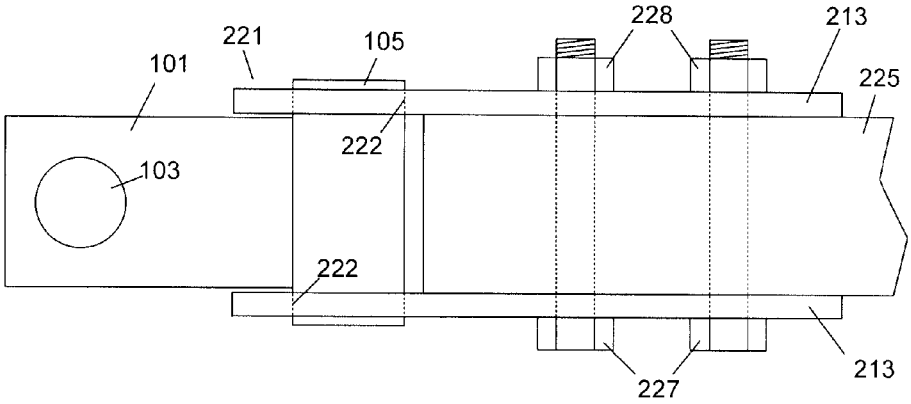

With reference to FIGS. 18-21, additional embodiments of a double axis frame strut are illustrated. FIG. 18 shows a side view of the strut frame 211 with the tongue 101 and FIG. 19 shows a top view of the strut frame 211. In this embodiment, the strut frame 211 includes two plates 213 that are secured to opposite sides of a beam 215. The beam 215 can have a rectangular cross section and may be made of wood, metal, plastic, composites, or any other suitable material. Threaded bolts 227 can be placed through holes 224 in the plates 213 and matching holes through the width of the beam 225. Nuts 228 can be secured to the ends of the bolts 227 to secure the plates 213 to the sides of the beam 225. As illustrated in FIG.

Figure 20:
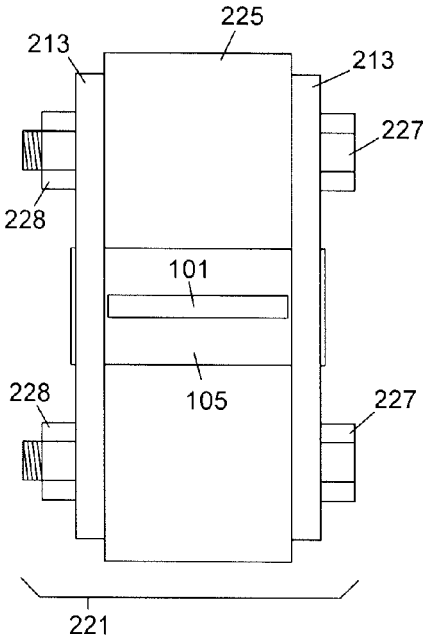
Figure 21:
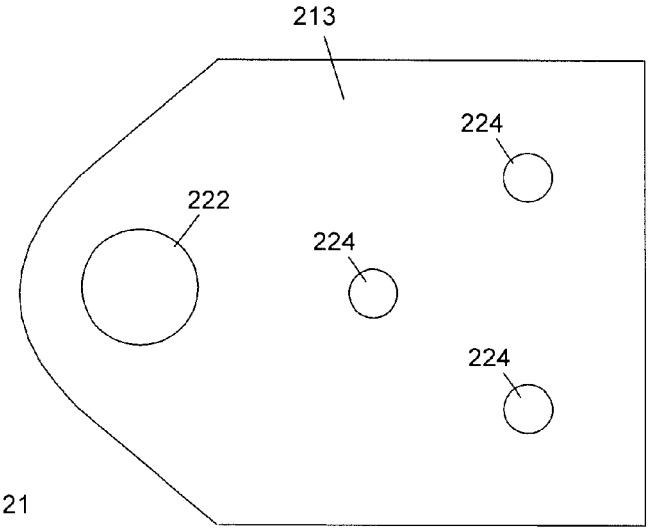
FIG. 21 illustrates a side view of a plate used with the strut frame.

18, the tongue 101 can rotate more than 180 degrees in the strut frame 221. FIG. 20 illustrates a front view of the tongue 101 in the strut frame 211 and FIG. 21 illustrates a side view of the plate 213 alone. The plate 213 can include a mounting hole 222 and a plurality of bolt holes 224.

Figure 22:
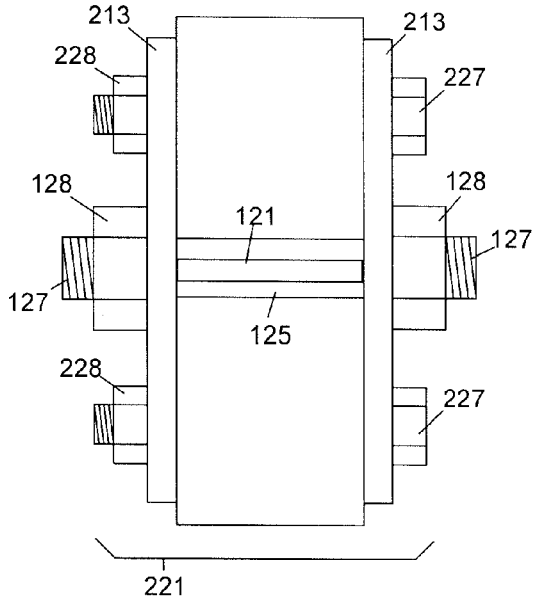
FIG. 22 illustrates a third embodiment of the strut frame with the tongue as illustrated in FIGS. 5 and 6.

FIG. 22 illustrates the third embodiment of the strut frame 221 with the tongue 121 illustrated in FIGS. 5 and 6. In this embodiment, the threaded ends 127 of the cylinder 125 are placed through the holes 222 in the plates 213 and nuts 128 are threaded onto the threaded ends 127. The nuts 128 can be tightened to press the inner surfaces of the plate 213 against the tongue 121. This compression can prevent the tongue 121 from rotating within the frame strut 221.

Figures 16, 23:
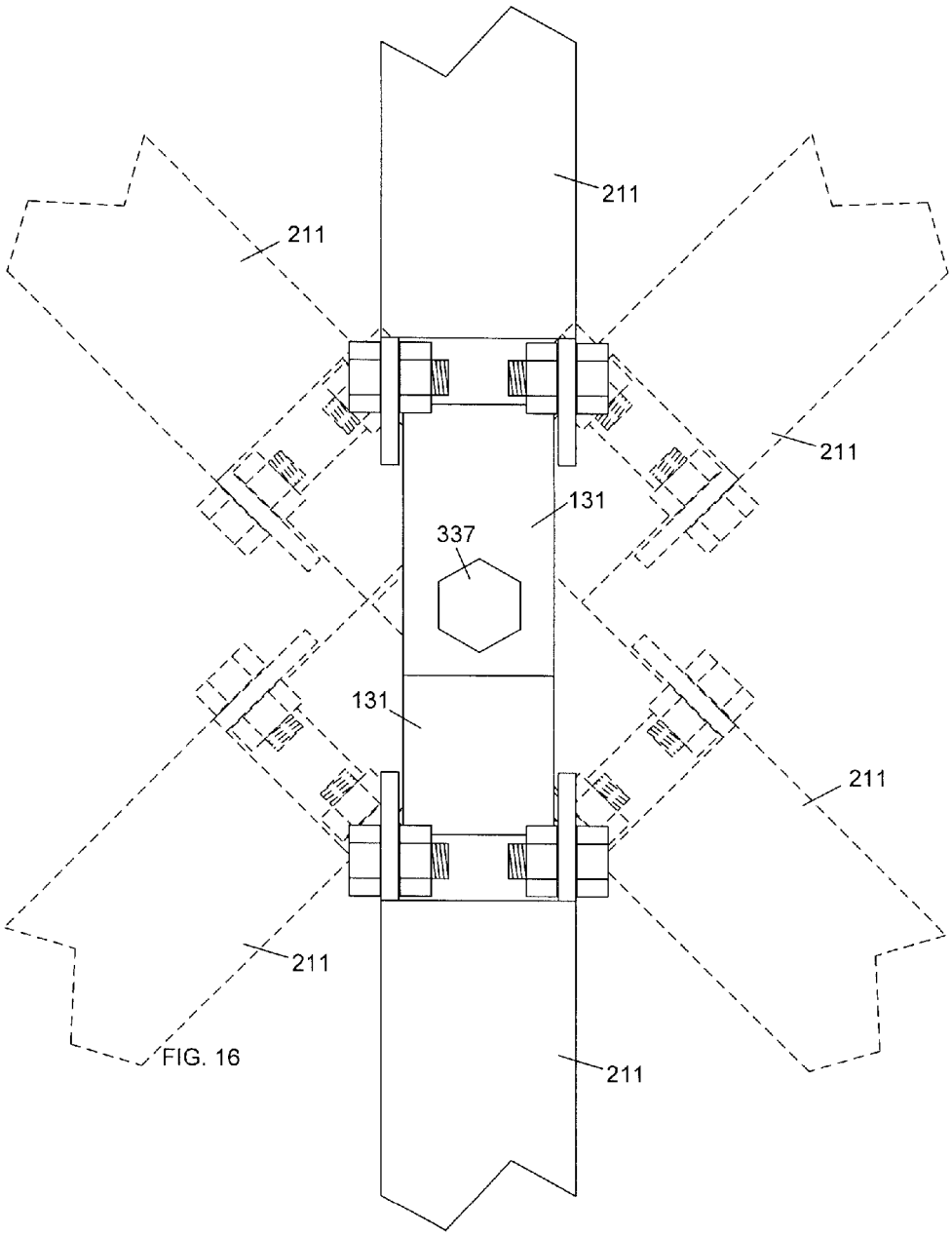
FIGS. 23 and 24 illustrate top and side views of two double axis frame struts coupled together.
Figure 24:
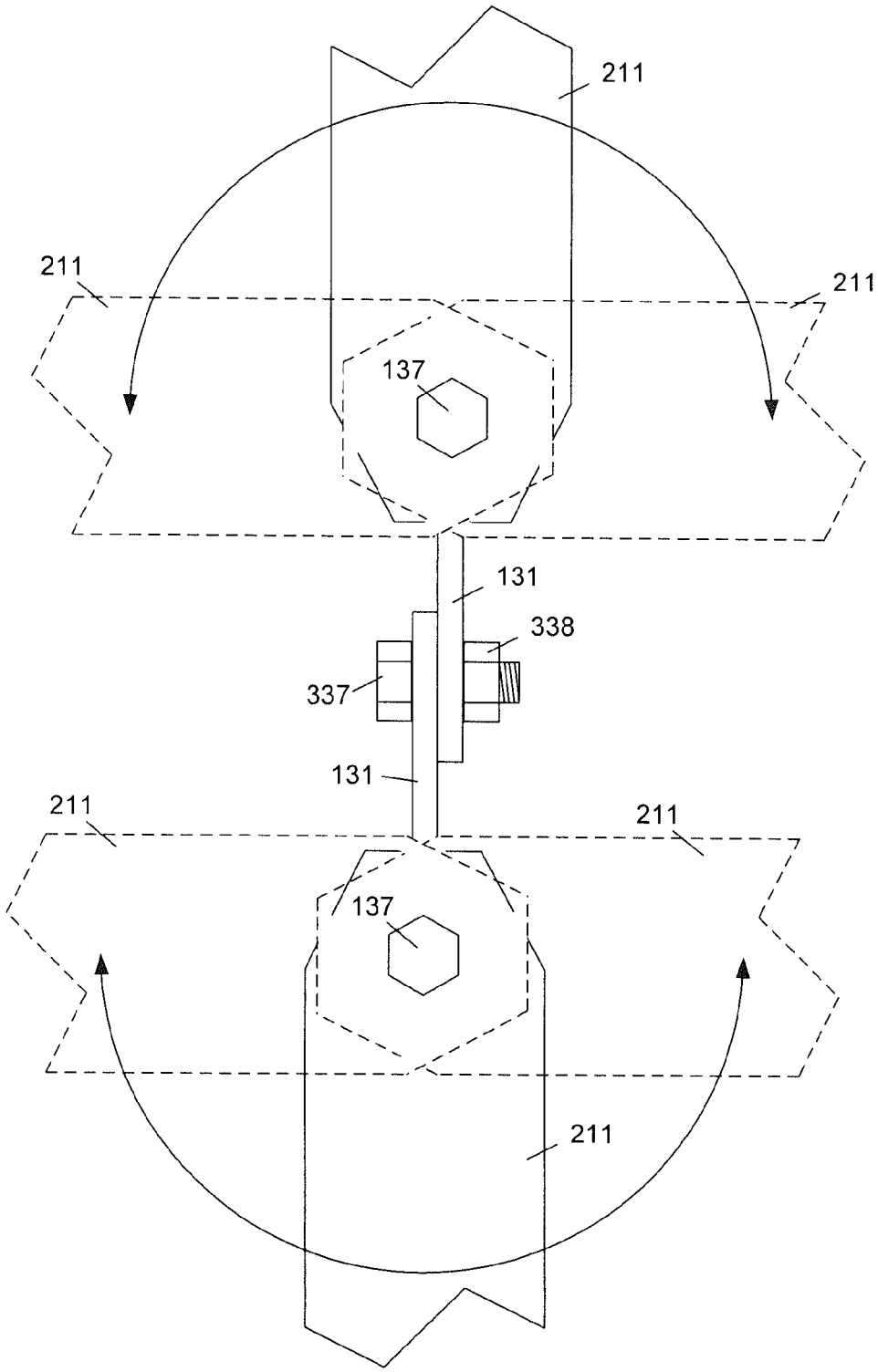

With reference to FIGS. 23 and 24, the inventive double axis frame struts can be joined with the tongues 131 coupled together. With reference to FIG. 23 a top view of the coupled frame struts is illustrated. A bolt 337 can be placed through the holes in the tongues 131 and a nut 338 can be placed around the end of the bolt 337 to secure the tongues 131 together. When the strut frames 211 are moved to the desired positions the bolt 337 and nut 338 can be tightened to secure the tongues 131 together and prevent movement about the axis defined by the bolt 337. FIG. 24 illustrates a side view of the coupled double axis frame struts. The strut frames 211 can rotate about the bolts 137. When the desired positions of the strut frames 211 are determined, the bolts 137 can be tightened to secure the strut frames 211 in the desired positions.

Figure 25:
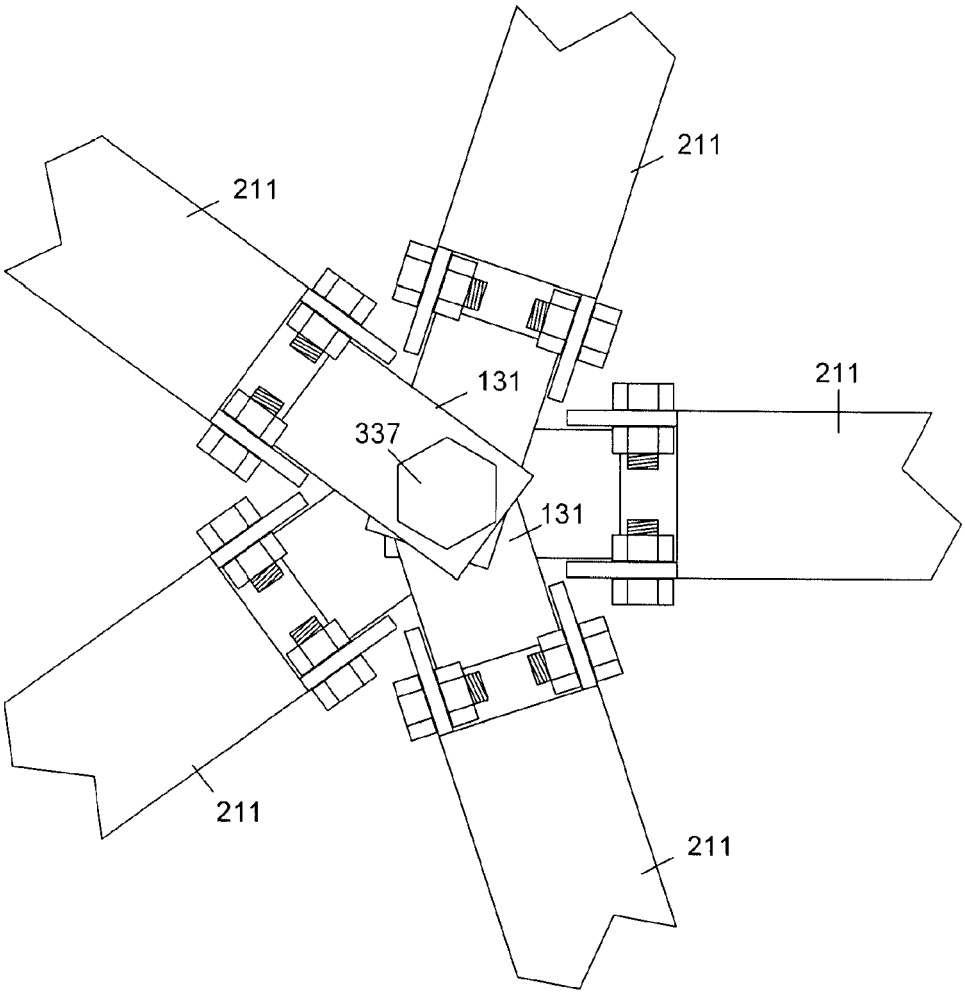
FIGS. 25-27 illustrate hubs that include multiple double axis frame struts.
Figure 26:
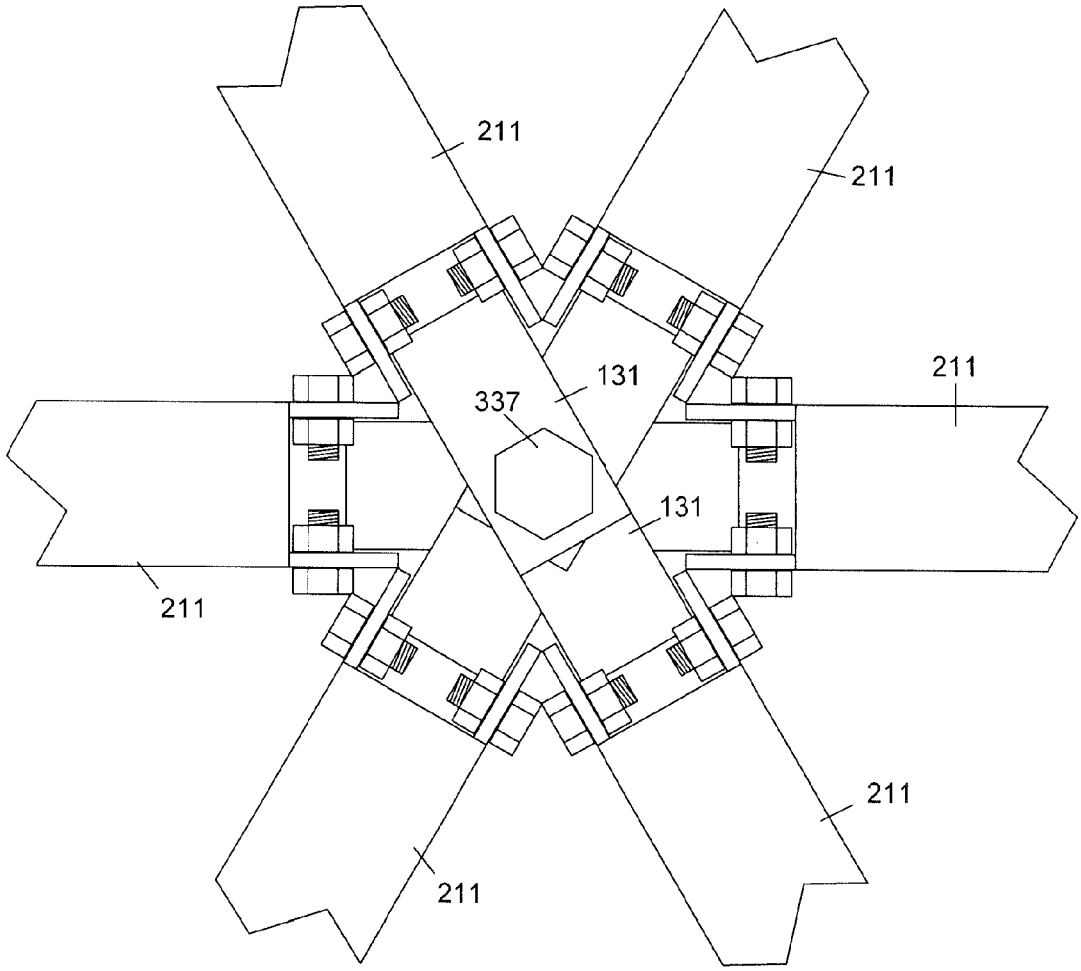
Figure 27:
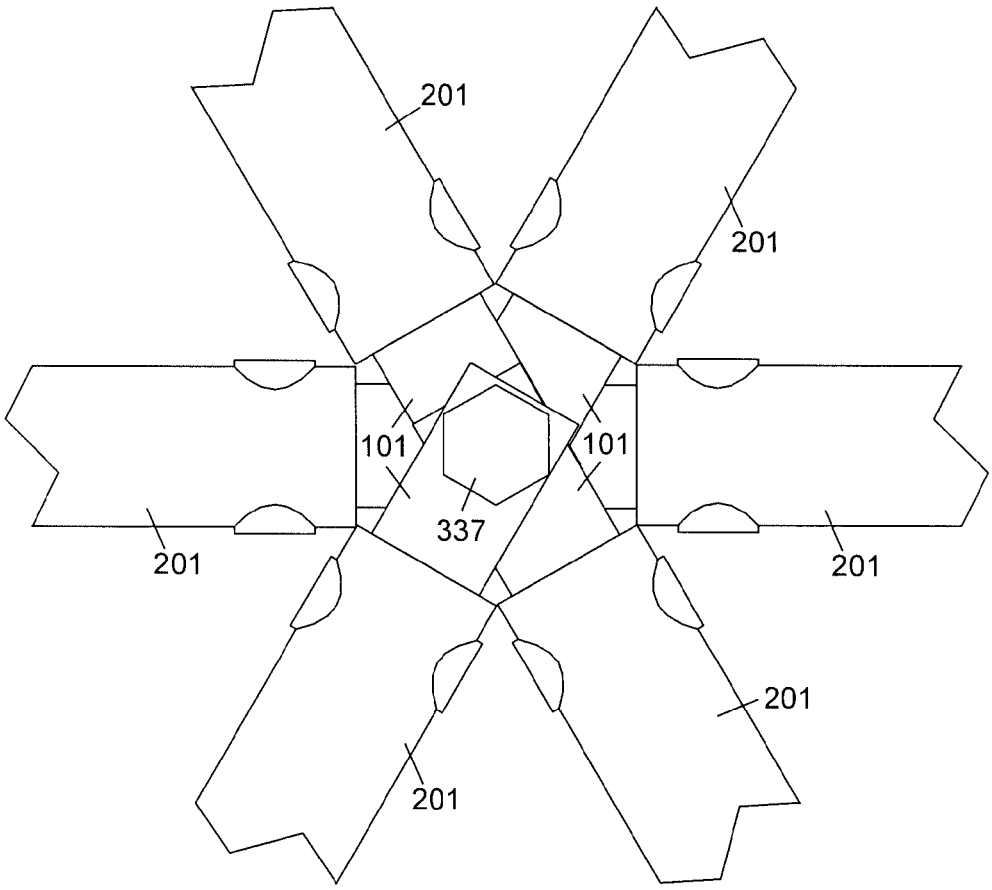

In other embodiments, many double axis frame struts can be joined together. FIG. 25 illustrates five tongues 131 secured together by a single bolt 337. FIG. 26 illustrates six tongues 131 secured together by a single bolt 337. FIG. 27 also illustrates six tongues 201 together by a single bolt 337. The strut frames can be evenly or unevenly distributed around the bolt 337. These types of multiple double axis frame strut hubs can be particularly useful when constructing frame supported structures such as geodesic domes.

Figure 28:
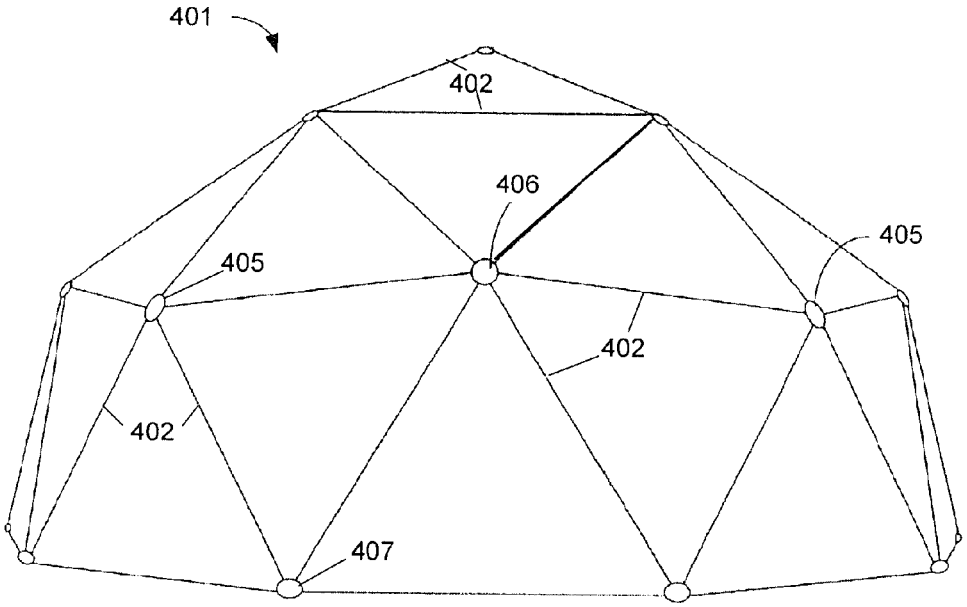
FIG. 28 illustrates a geodesic dome.

With reference to FIG. 28, a geodesic dome 401 is illustrated. A geodesic dome 401 is a type of structure constructed with straight elements that form interlocking polygons. The structure is comprised of a complex network of polygons, usually triangles, which form a roughly spherical surface. The more complex the network of polygons, the more closely the dome approximates the shape of a sphere. In the embodiment shown in FIG. 28, there are two types of hubs 405, 406 that join the ends of the beams 402. Hub 406 is a connector taking a shape similar to a hexagon, in that it fastens to six beams 402, whereas hub 405 takes a shape similar to a pentagon. The hub 207 at the bottom edge of the geodesic dome 401 is similar to the hub 406 with the lower two beams connected to hub 406 omitted. The hubs 405, 406, 407 can be similar to the hubs illustrated in FIGS. 25-27. In other embodiments, the inventive double axis frame struts can be used for other structures.

Figure 29:
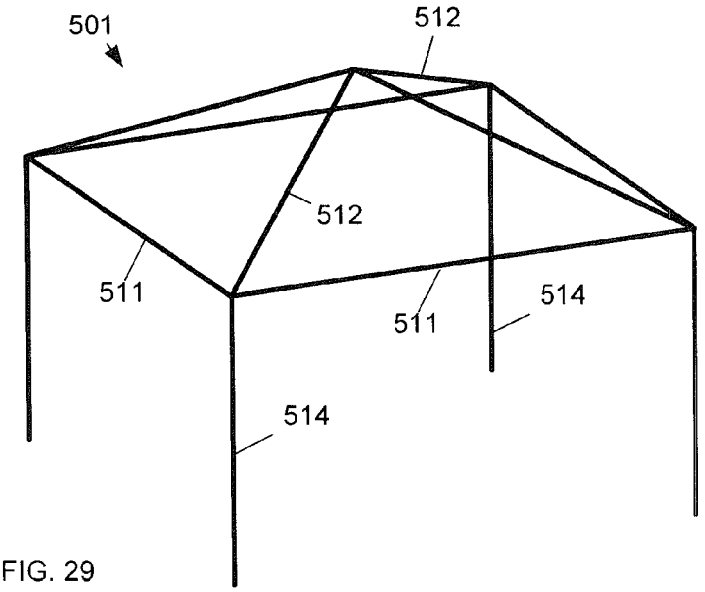
FIGS. 29 and 30 illustrate free standing structures that can be constructed with the double axis frame struts.

FIG. 29 shows an isometric view of an exemplary embodiment of a beam and truss structure 501 that can be covered with a canopy. The beam and truss structure 501 comprises a plurality of beams 511, a plurality of truss beams 512, and a plurality of legs 514. Each of these components can rigidly together as described above using the inventive double axis frame struts.

Figure 30:
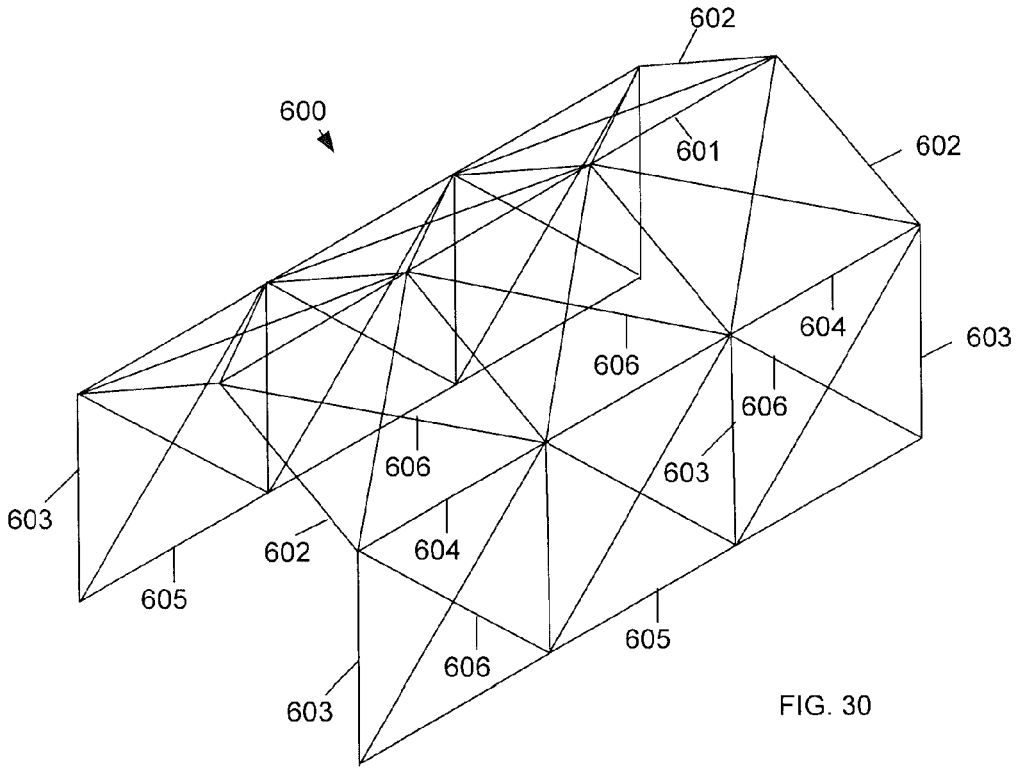

FIG. 30 illustrates another exemplary embodiment of a free standing structure. The structure 600 comprises a ridge beam 601 at the apex of structure 600 that spans between pairs of truss beams 602. Leg beams 603 are coupled to the truss beams 602 at the lower end of truss beams 602. Upper leg beams 604 extend between the tops of the leg beam 602. Lower leg beams 605 extend between the lower ends of the legs 604 in parallel to the upper leg beams 604. Additional cross beams 606 can be placed diagonally between the ridge beam 601, the truss beams 602, the leg beams 603, the upper leg beams 604 and the lower leg beams 605. It should be understood that structure 600 could comprise any number of sections. Additionally, the various components forming structure 600 can be formed from any suitable material, such as, but not limited to, steel, metal alloys and/or composite materials, that provide sufficient strength for the stresses that are experienced by a structure such as structure 100. The exemplary structure 600, or variations of exemplary structure 600, could be used as, but not limited to, a structure for a garage/canopy for a vehicle, a motorcycle, a bicycle, a covered walkway, a greenhouse, a party tent, an animal shelter, a pavilion tent, a temporary shelter, a storage facility, a boat garage/canopy. Additionally, it should be understood that exemplary structure 600, or variations of exemplary structure 600, could be scaled in size for the intended application.

The angle or pitch of the rooftop of the illustrated structures is determined by the width of the supporting structure connected to the truss beams. An advantage of the double axis connection is that it will adjust and lock to any angle required by the supporting structure up to 180 degrees or more at the strut end.

Figure 31:
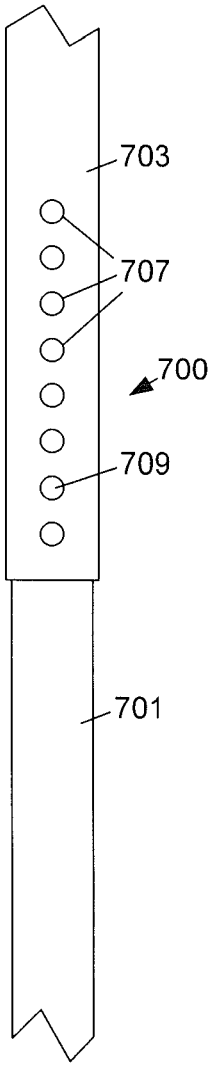
FIGS. 31-35 illustrate views of an adjustable length beam.

In an embodiment, the inventive double axis frame struts can be used with telescopic struts. In these embodiments, the roof pitch angle could be adjusted to any desired degree of slope. The design could also be incorporated into an adjustable truss. FIGS. 31-35 illustrate embodiments of an adjustable length beam 700. FIG. 31 illustrates an embodiment of a telescopic beam 700 that includes an inner member 701 and an outer tube 703. The inner member can have a pin mechanism 709 that can engage one of a series of holes 707 in the outer tube 703. The telescopic configuration can rotate or extend as needed for any framing requirement. This locking strut connection can also be used with any pipe or tubing strut material, metal structural pipe, EMT or plastic HDPE and PVC.

Figure 32:
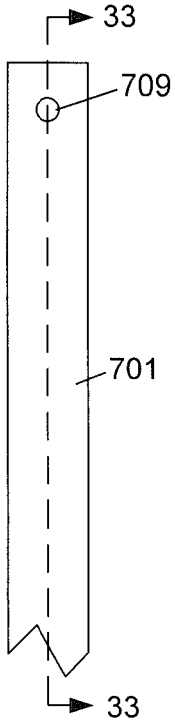
Figure 33A:
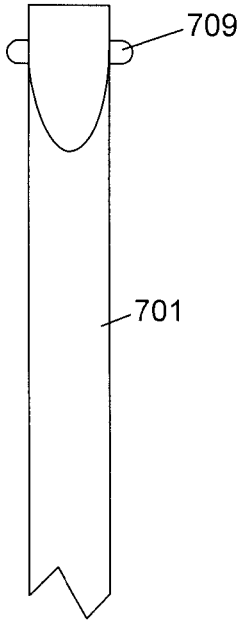
Figure 33B:
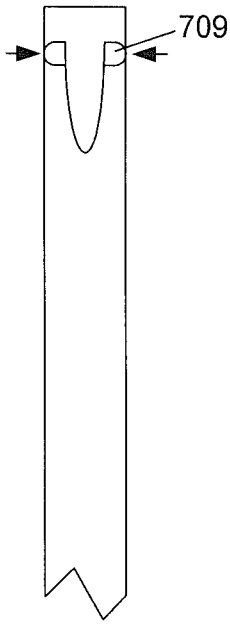

FIG. 32 illustrates side view of an embodiment of the inner member 701. FIG. 33A illustrates a cross sectional view of the inner member 701 with the pin mechanism 709 in the expanded state. The pin mechanism may include one or two rounded pins that are coupled to the ends of a spring mechanism. The pins may extend through holes in the side wall of the inner member 701. FIG. 33B illustrates the inner member with the inner member 701 with the pins compressed so the ends of the pins do not protrude beyond the outer diameter of the inner member 701. In the compressed state, the inner member can be moved to change the length of the adjustable length beam 700. Once the inner member 701 is placed in the desired extension or position the pin mechanism 709 can be released to engage one or more holes in the outer tube 703.

Figure 34:
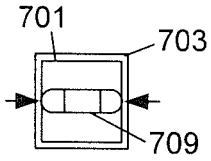
Figure 35:
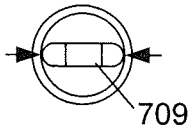

The cross section of the adjustable length beam 700 can be any geometric shape. FIG. 34 illustrates an end view of an adjustable length beam having a rectangular cross section and FIG. 35 illustrates another embodiment of the adjustable length beam having a circular cross section.

It will be understood that the inventive system has been described with reference to particular embodiments, however additions, deletions and changes could be made to these embodiments without departing from the scope of the inventive system. Although the order filling apparatus and method have been described include various components, it is well understood that these components and the described configuration can be modified and rearranged in various other configurations.

What is claimed is:

1. A double axis frame strut comprising:

a strut frame member having an interior dimension, a length, a width and two mounting holes formed symmetrically through the width of the strut frame;

a cylinder rotatably mounted through the two mounting holes of the strut frame member and extending beyond the width of the strut frame member, wherein the cylinder has a first axis of rotation that is perpendicular to the length of the strut frame member; and a substantially flat tongue rigidly coupled at a proximal end thereof to the cylinder within the interior dimension of the strut frame member, the tongue extending out of the strut frame member in a plane that is rotatable with the cylinder about the first axis of rotation, the tongue having a connector hole formed on a distal portion thereof, the connector hole defining a second axis of rotation that is perpendicular to the first axis of rotation, wherein the double axis frame strut can be rotated about the first axis of rotation and the second axis of rotation.

2. The double axis frame strut of claim 1 further comprising:

a locking mechanism for preventing the tongue and the cylinder from rotating relative to the strut frame.

3. The double axis frame strut of claim 2 wherein at least one end of the cylinder is threaded and the locking mechanism is a nut coupled to one end of the cylinder that is tightened to prevent the tongue and the cylinder from rotating relative to the strut frame.

4. The double axis frame strut of claim 1 wherein the tongue can rotate 180 degrees relative to the strut frame.

5. The double axis frame strut of claim 1 wherein at least a portion of the strut frame member is a cylindrical tube.

6. The double axis frame strut of claim 1 wherein at least a portion of the strut frame is a tube having a rectangular cross section.

7. The double axis frame strut of claim 1 wherein the strut frame includes a first plate and a second plate, the first plate and the second plate each having one of the two mounting holes.

8. The double axis frame strut of claim 7 wherein the first plate and the second plate are fastened to opposite sides of a beam.

* * * * *